US012004661B2

(12) United States Patent
Reinhart

(10) Patent No.: US 12,004,661 B2
(45) Date of Patent: Jun. 11, 2024

(54) CHAIR FOR OUTDOORS

(71) Applicant: NICKOLAS BRANDS, LLC, Findlay, OH (US)

(72) Inventor: Nickolas Reinhart, Sarasota, FL (US)

(73) Assignee: FINDLAY MACHINE & TOOL, LLC, Findlay, OH (US)

( * ) Notice: Subject to any disclaimer, the term of this patent is extended or adjusted under 35 U.S.C. 154(b) by 25 days.

(21) Appl. No.: 17/884,017

(22) Filed: Aug. 9, 2022

(65) Prior Publication Data

US 2023/0052024 A1 Feb. 16, 2023

Related U.S. Application Data

(60) Provisional application No. 63/231,298, filed on Aug. 10, 2021.

(51) Int. Cl.

| | |
|---|---|
| ***A47C 3/04*** | (2006.01) |
| ***A47C 1/00*** | (2006.01) |
| ***A47C 7/02*** | (2006.01) |
| ***A47C 7/54*** | (2006.01) |

(52) U.S. Cl.

CPC ..... *A47C 7/54* (2013.01); *A47C 1/00* (2013.01); *A47C 3/04* (2013.01); *A47C 7/028* (2013.01)

(58) Field of Classification Search

CPC ..... A47C 3/04; A47C 7/028

See application file for complete search history.

(56) References Cited

U.S. PATENT DOCUMENTS

| | | | | | |
|---|---|---|---|---|---|
| D109,239 | S * | 4/1938 | Wolpin | D6/370 | |
| 2,118,676 | A * | 5/1938 | Lankton | A47C 3/025 | 297/452.63 X |
| 4,635,998 | A * | 1/1987 | Hickey | A47C 4/08 | 297/39 |
| 4,707,023 | A * | 11/1987 | Hickey | A47C 4/08 | 297/39 |
| 4,976,492 | A * | 12/1990 | Ziegler | A47C 4/14 | 297/39 |
| 5,120,071 | A * | 6/1992 | Thibault | A47C 7/006 | D6/370 |
| 5,911,469 | A * | 6/1999 | Young | A47C 7/54 | 297/39 |
| 6,811,226 | B1 * | 11/2004 | Kamrath | A47C 11/00 | 297/440.16 |
| D570,127 | S * | 6/2008 | Spink | D6/370 | |
| D668,075 | S * | 10/2012 | Mosley | D6/403 | |
| 8,333,430 | B2 * | 12/2012 | Adams | A47C 7/462 | 297/452.63 X |
| 8,528,979 | B2 * | 9/2013 | College | F16B 12/26 | 297/452.63 X |
| D777,465 | S * | 1/2017 | Milde | D6/370 | |
| 9,532,654 | B1 * | 1/2017 | Adams, IV | A47C 7/68 | |

(Continued)

*Primary Examiner* — Rodney B White

(74) *Attorney, Agent, or Firm* — Jacob M. Ward; Ward Law Office LLC

(57) ABSTRACT

An outdoor chair is provided that can include a seat, a pair of front legs, a pair of rear legs, a backrest, and a pair of armrests. The pair of front legs and the pair of back legs can both depend from the seat. The backrest can be disposed adjacent to the seat. The pair of armrests can be coupled to the front legs and the backrest, where each armrest can be coupled to the backrest with a flared protrusion. The rear legs can include an angled leg extension and the seat can include a plurality of horizontal slats.

2 Claims, 5 Drawing Sheets

(56) References Cited

U.S. PATENT DOCUMENTS

| | | | | |
|---|---|---|---|---|
| 9,655,452 | B2 * | 5/2017 | Hoedebecke | A47C 7/70 |
| 9,675,176 | B2 * | 6/2017 | Adams, IV | B29C 45/16 |
| 11,266,246 | B2 * | 3/2022 | Warren | F16B 12/125 |
| D995,135 | S * | 8/2023 | Zhaowen | D6/370 |
| 2005/0200167 | A1 * | 9/2005 | Bollenbach | A47C 1/14 297/181 |
| 2006/0163920 | A1 * | 7/2006 | Adams | A47C 1/0265 297/239 |
| 2022/0330701 | A1 * | 10/2022 | Goodworth | A47C 3/04 |
| 2023/0165371 | A1 * | 6/2023 | Reinhart | A47C 7/624 297/239 |
| 2023/0200544 | A1 * | 6/2023 | Reinhart | A47C 11/005 297/232 |

* cited by examiner

CHAIR FOR OUTDOORS

CROSS-REFERENCE TO RELATED APPLICATIONS

This application claims the benefit of U.S. Provisional Application No. 63/231,298, filed on Aug. 10, 2021. The entire disclosure of the above application is incorporated herein by reference.

FIELD

The present technology relates to outdoor chairs.

INTRODUCTION

This section provides background information related to the present disclosure which is not necessarily prior art.

Adirondack chairs are a larger type of chair and are a very popular outdoor seating option. For many years, these chairs were made of wood with the pieces of the chair nailed, glued, bolted, or screwed together to form a single unit. Adirondack chairs have a straight back that is formed by multiple wooden planks that extend from a seat at an angle. Most wooden Adirondack chairs are not foldable, are heavy, and are also very difficult to stack.

More recently, some Adirondack chairs have been made of plastic. These chairs are molded to look like the wooden Adirondack chairs. Such molded plastic chairs are lighter and may be more weather resistant than their wooden predecessors. Further, the molded plastic chairs may be stored more efficiently since the molded plastic chairs may often be stacked on top of one another.

The design of currently available molded plastic chairs, however, is plagued with issues of durability. For instance, the currently available molded plastic chairs often break under pressure during normal use. Common breaking points on the currently available molded plastic chairs include the arm rests, the rear legs, and the seat. The armrests commonly break along their connection with the backrest. The rear leg and seat designs of the currently available molded plastic chairs are inadequate to withstand the pressure of normal use.

Accordingly, there is a need for an improved outdoor chair that has enhanced durability.

SUMMARY

In concordance with the instant disclosure, an improved outdoor chair with enhanced durability, has surprisingly been discovered.

An outdoor chair is provided that can include a seat, a pair of front legs, a pair of rear legs, a backrest, and a pair of armrests. The pair of front legs and the pair of back legs can both depend from the seat. The backrest can be disposed adjacent to the seat. The pair of armrests can be coupled to the front legs and the backrest, wherein each armrest can be coupled to the backrest with a flared protrusion. The rear legs can include an angled leg extension and the seat can include a plurality of horizontal slats.

In certain embodiments, the flared protrusion may include a rounded sidewall, a rounded top wall, and a substantially flat sidewall. The interior of the flared protrusion may be substantially hollow. The flared protrusion may have a bottom area that is substantially open. The rounded sidewall and substantially flat sidewall of the flared protrusion may extend for a length beyond a rear surface of the backrest. In a specific example, the flared protrusion may be disposed at an angle between thirty degrees and eighty-five degrees relative to a plane parallel with a remainder of the armrest. In a more specific example, the flared protrusion may be disposed at an angle between forty-five degrees and seventy-five degrees. In a most specific embodiment, the flared protrusion may be disposed at an angle of about seventy degrees. Advantageously, it is believed the shape, angle, and the length of the flared protrusion enhance the structural integrity and durability of the outdoor chair.

In certain embodiments, each of the rear legs may include a first panel and a second panel. The second panel may be disposed substantially perpendicular to the first panel. Advantageously, it is believed the angled leg extension of the first panel enhances the structural integrity and durability of the outdoor chair. Desirability, the angled leg extension of the rear legs may disperse pressure more evenly throughout the rear legs, thereby militating against the rear legs from breaking.

In certain embodiments, the seat may include a plurality of horizontal slats. Each horizontal slat may include a brace between adjacent slats. Advantageously, the brace enhances the structural integrity of the seat. In a specific, non-limiting example, the seat may include a pair of braces between each adjacent slat. The pair of braces may be evenly distributed across a width of the seat. Desirably, the pair of braces may enhance the durability of the seat by more evenly distributing pressure from normal use across a larger area of the seat.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
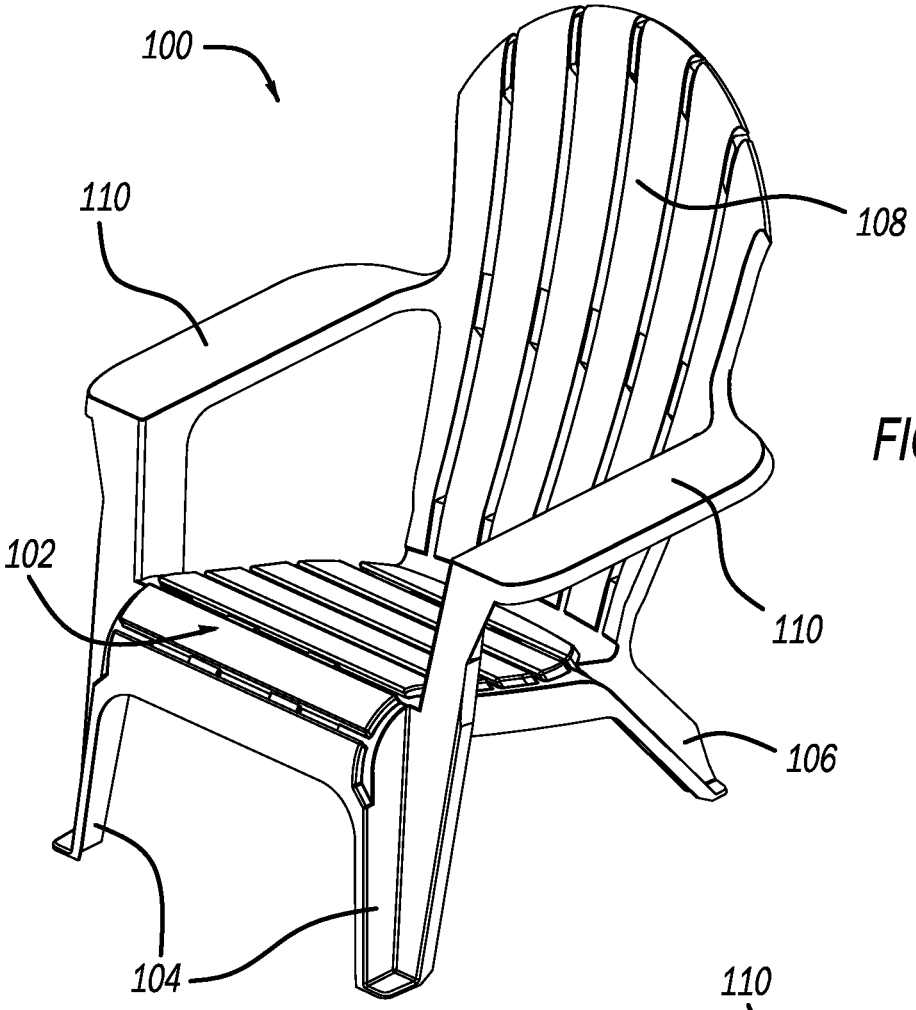
FIG. 1 is a top perspective view of an outdoor chair, according to an embodiment of the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology relates to a chair 100 for the outdoors, aspects of which are shown generally in FIGS. 1-9. With particular reference to FIGS. 1-4, the chair 100 can include a seat 102, a pair of front legs 104, a pair of rear legs 106, a backrest 108, and a pair of armrests 110. The pair of front legs 104 and the pair of rear legs 106 can both depend from the seat 102. The backrest 108 can be disposed adjacent to the seat 102. The pair of armrests 110 can be coupled to the front legs 104 and the backrest 108, where each armrest 110 can be coupled to the backrest 108 with a flared protrusion 112.

In certain embodiments, the chair 100 can be contiguous and form a unitary body with all parts of the chair 100 sharing an uninterrupted surface. In a more specific example, the chair 100 can be injection molded, producing one continuous body in which each of the components is formed of the same material. For example, the chair 100 can be injection molded and formed by a single piece of plastic or metal, allowing the various portions of the chair 100 to be formed without assembling separate components, including where separate components are coupled using fasteners.

The chair 100 can be formed from a solid material. The solid material can allow for the chair 100 to be stable and durable as it is weathered from the outdoors. As non-limiting examples, the chair 100 can be formed from various polyolefins and mixtures thereof, polypropylene, high density polyethylene (HDPE), and/or polyethylene terephthalate (PET). One of ordinary skill in the art can select other suitable materials for forming the chair 100 within the scope of the present disclosure.

Figure 7:
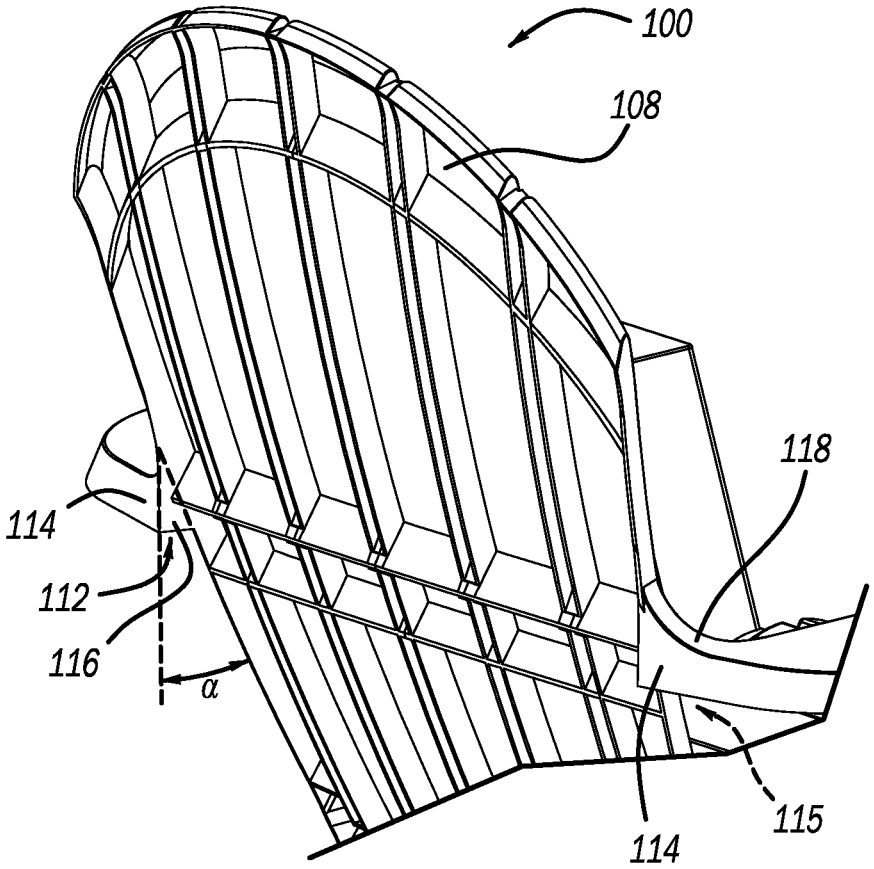
FIG. 7 is a rear perspective view of a portion of a backside of a backrest of the outdoor chair.
Figure 8:
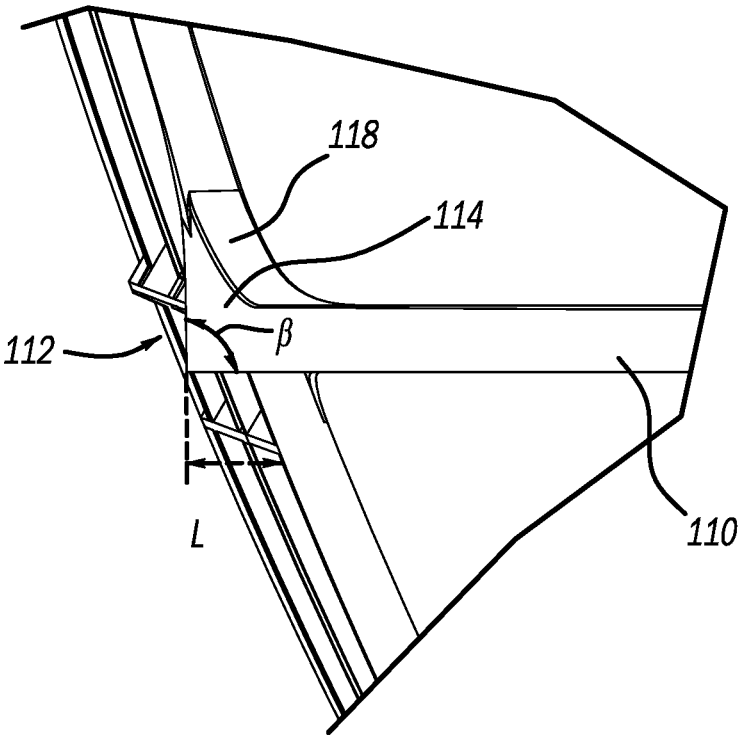
FIG. 8 is a side elevational view of a portion of the outdoor chair where the armrest joins the backrest.

As shown in FIGS. 7-8, the flared protrusion 112 can include a first sidewall 114, a second sidewall 116, and a top wall 118. The first sidewall 114 and the top wall 118 can be curved. The second sidewall 116 can be substantially flat. The curved nature of the first sidewall 114 and the top wall 118 can provide more flexibility, and therefore more stability, as the chair moves with a user and can militate against the chair fatiguing, cracking, or breaking under pressure. The substantially flat shape of the second sidewall 116 can militate against each of the pair of armrests 110 moving outward and fatiguing, cracking, or breaking. The flat surface can militate against the arms becoming misshaped over time as an individual uses the chair 100 and applies outward pressure with their body upon the armrests 110. One of ordinary skill in the art can select a suitable curvature for the first sidewall 114 and the top wall 118 within the scope of the present disclosure. With reference to FIG. 7, the flared protrusion 112 can include a hollow interior 115. The hollow interior 115 can be defined by the first sidewall 114, the second sidewall 116, and the top wall 118. Desirably, the hollow interior 115 can allow the chair 100 to maintain flexibility and torque, which, in turn, can allow for the chair 100 to move with the user and militate against the chair 100 breaking from pressure.

The first sidewall 114 and the second sidewall 116 can extend outwardly from the backrest for a length (L) and at an angle (α), as shown in FIGS. 7-8. As a non-limiting example, the length (L) can be between about 3 centimeters and about 15 centimeters. More specifically, the length (L) can be 9 centimeters. One of ordinary skill in the art can select a suitable length (L) for the second sidewall 116 to extend from the backrest 108 within the scope of the present disclosure. As another non-limiting example, the angel (α) at which the flared protrusion 112 extends from the backrest 108 can be between about 20° and about 70°. More specifically, the angle (a) can be between about 35° and about 55°. Most particularly, the angle (α) can be about 45°. One of ordinary skill in the art can select a suitable angle (α) at which the flared protrusion 112 extends from the backrest 108 within the scope of the present disclosure. As a result of the length (L) and angle (α) falling within the stated non-limiting ranges, the chair 100 can maintain structural integrity and militate against the chair 100 fatiguing, cracking, or breaking where the armrests 110 join the backrest 108.

As shown in FIG. 8, the flared protrusion 112 can be disposed at an angle (β) relative to a plane parallel with the armrest 110. As a non-limiting example, the angle (β) can be between about 30° and about 85°. More specifically, the angle (β) can be between about 45° and 75°. Most particularly, the angle (β) can be about 70°. One of ordinary skill in the art can select a suitable angle (β) of the flared protrusion 112 relative to the plane parallel with the armrest 110 within the scope of the present disclosure. Desirably, as a result of the angle (β) falling within the stated non-limiting range, the chair 100 can maintain structural integrity and durability as well as militate against the chair 100 fatiguing, cracking, or breaking where the armrests 110 join the backrest 108.

Figure 2:
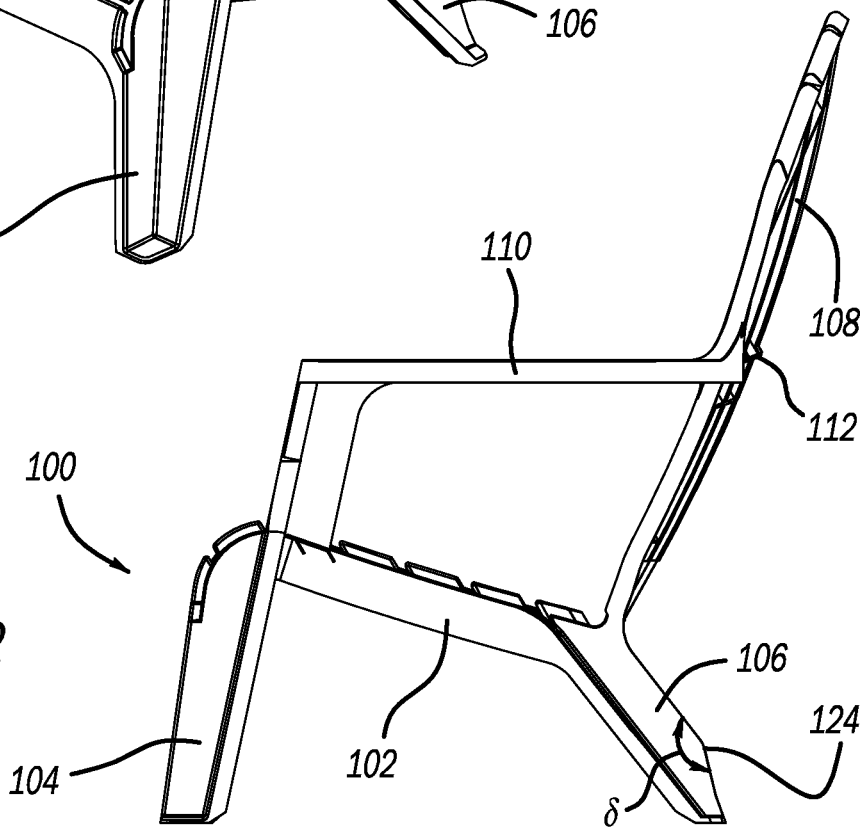
FIG. 2 is a side elevational view thereof.
Figure 3:
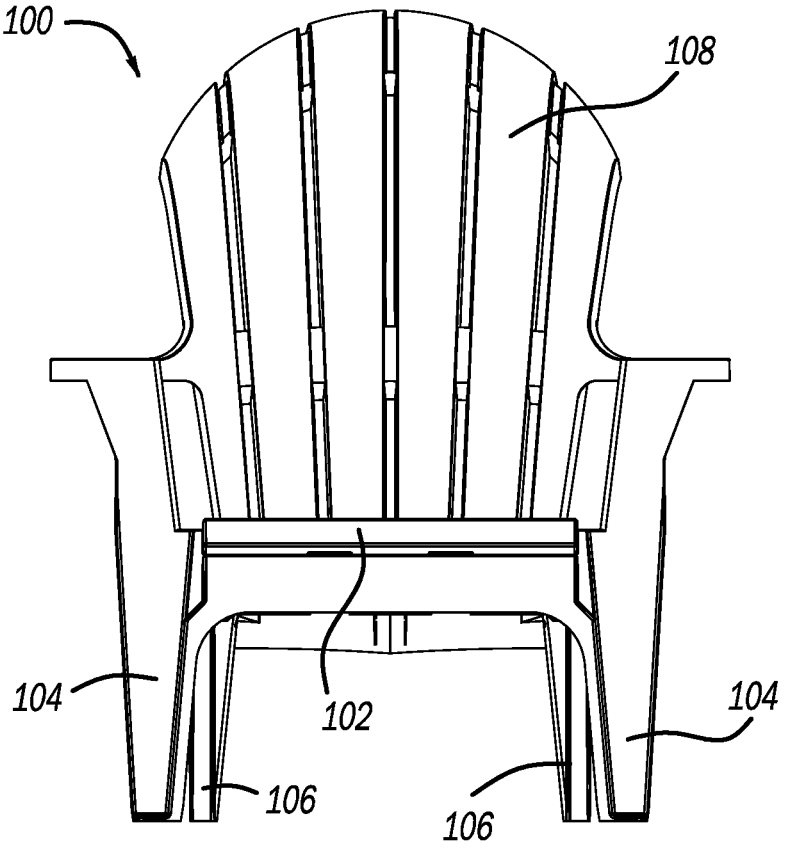
FIG. 3 is a front elevational view thereof.
Figure 9:
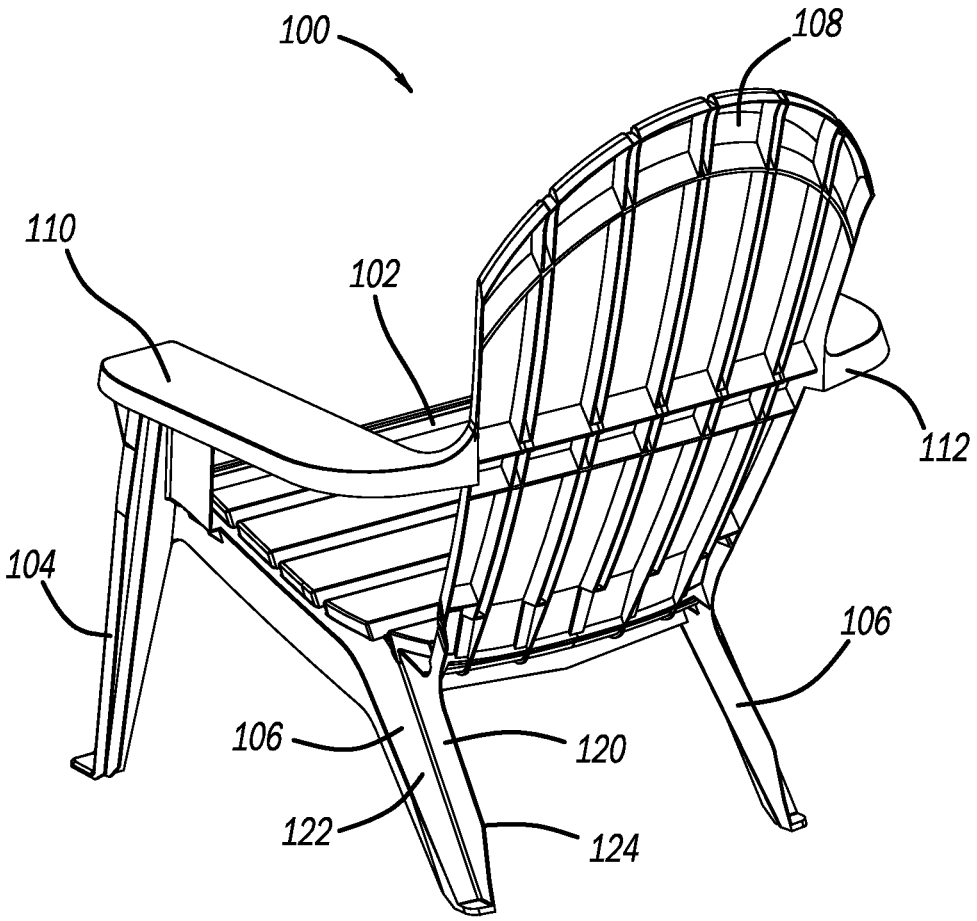
FIG. 9 is a rear perspective view of a portion of the outdoor chair.

With reference to FIGS. 2 and 9, the pair of rear legs 106 includes a first panel 120 and a second panel 122. The second panel 122 can be disposed substantially perpendicular to the first panel 120. The first panel 120 can include an angled leg extension 124 disposed at an angle (δ), shown in FIG. 2. As a non-limiting example, the angle (δ) of the angled leg extension 124 can be between about 170° and about 140°. More specifically, the angle (δ) can be between about 165° and 145°. Most particularly, the angle (δ) can be about 156°. One of ordinary skill in the art can select a suitable angle (δ) for the angled leg extension 124 within the scope of the present disclosure. Advantageously, the angled leg extension 124 can allow for pressure to be evenly distributed throughout the rear legs 106 when the chair 100 is in use and militate against the rear legs 106 fatiguing, cracking, or breaking. Therefore, the angled leg extension 124 can enhance the structural durability of the chair 100. Further, the angled leg extensions 124 can militate against the chair 100 sinking into the ground when the ground is soft and/or muddy.

Figure 4:
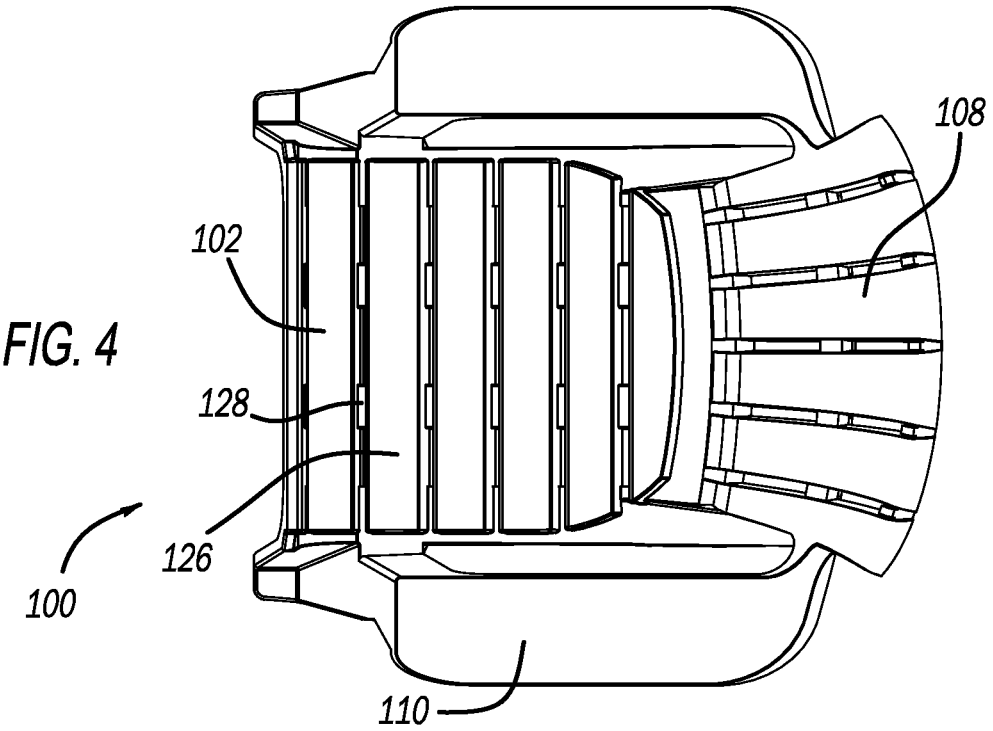
FIG. 4 is a top plan view thereof.
Figure 5:
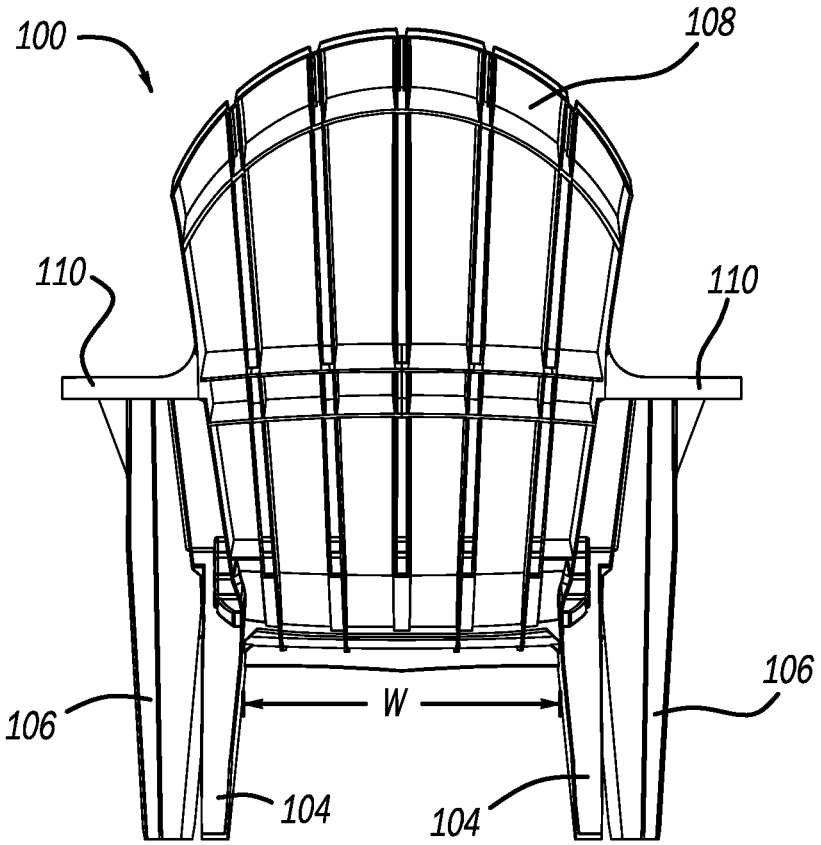
FIG. 5 is a rear elevational view thereof.
Figure 6:
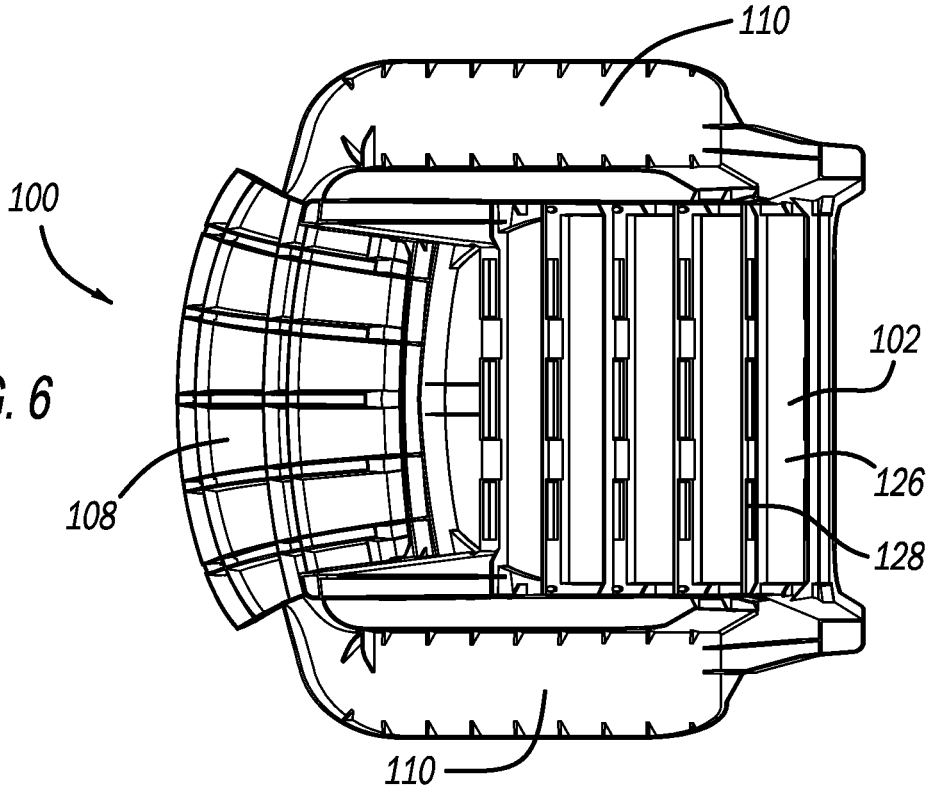
FIG. 6 is a bottom plan view thereof.

As shown in FIGS. 4 and 6, the seat 102 can include a plurality of horizontal slats 126. A brace 128 can be disposed between adjacent horizontal slats 126. In a specific example, the seat 102 can include a pair of braces 128 between adjacent horizontal slats 126. The pair of braces 128 can be distributed evenly across the width (W) of the seat 102, shown in FIG. 5. Desirably, the braces 128 may enhance the durability of the seat 102 by more evenly distributing pressure from normal use across a larger area of the seat 102. In a more specific example, the pair of braces 128 may substantially align with the ischial tuberosities (not shown) of a pelvis of an average sized user. Where the pair of braces 128 substantially align with the ischial tuberosities (not shown) of the average sized user, the area in the seat receiving the most pressure may be most adequately supported while still minimizing the overall weight of the chair 100. In this way, the braces 128 can militate against the seat 102 fatiguing, cracking, or breaking.

Advantageously, the chair 100 of the present disclosure can provide additional stability and durability that can extend the life of the chair 100. Desirably, the flared protrusion 112, the angled leg extension 124, and the brace 128 between adjacent slats 126 in the seat 102 can contribute to enhanced features, provide for a better user experience, while optimizing performance of the chair 100.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. An outdoor chair, comprising:

a seat;

a pair of front legs depending from the seat;

a pair of rear legs depending from the seat;

a backrest disposed adjacent to the seat; and a pair of armrests coupled to the pair of front legs and the backrest, wherein each armrest is coupled to the backrest with a flared protrusion, wherein the flared protrusion includes a hollow interior.

2. The outdoor chair of claim 1, wherein the flared protrusion includes a first sidewall, a second sidewall, and a top wall which define the hollow interior.

* * * * *